United States Patent [19]

Betts

[11] 4,042,312

[45] Aug. 16, 1977

[54] APEX SEAL ASSEMBLY

[75] Inventor: Edmund Douglas Betts, Gurnee, Ill.

[73] Assignee: Outboard Marine Corporation, Waukegan, Ill.

[21] Appl. No.: 714,564

[22] Filed: Aug. 16, 1976

[51] Int. Cl.[2] ..... F04C 27/00

[52] U.S. Cl. ..... 418/121; 418/122

[58] Field of Search ..... 418/113, 120, 121, 122, 418/123

[56] References Cited

U.S. PATENT DOCUMENTS

| | | | |
|---|---|---|---|
| 3,794,450 | 2/1974 | Klomp | 418/122 X |
| 3,865,521 | 2/1975 | Upchurch | 418/121 |
| 3,899,272 | 8/1975 | Pratt | 418/123 X |

*Primary Examiner*—Carlton R. Croyle
*Assistant Examiner*—Leonard Smith
*Attorney, Agent, or Firm*—Arthur Frederick; Victor D. Behn

[57] ABSTRACT

The improved apex seal assembly for a rotary piston of multi-corner profile having a plurality of contiguous peripheral surfaces intersecting at apex portions comprises a seal blade means receivable in a radial slot in each apex portion and an intermediate seal pin means for each apex portion and disposed in and rotatable relative to a bore communicating with the slot. The intermediate seal pin means is so formed as to have a sealing edge portion. A spring is located to exert a force on the intermediate seal pin means offset from its longitudinal axis so as to urge the intermediate seal pin means to rotate in a direction to maintain the sealing edge portion thereof into engagement against the seal blade means regardless of the amount and changes in differential gas pressure across the seal blade means.

12 Claims, 7 Drawing Figures

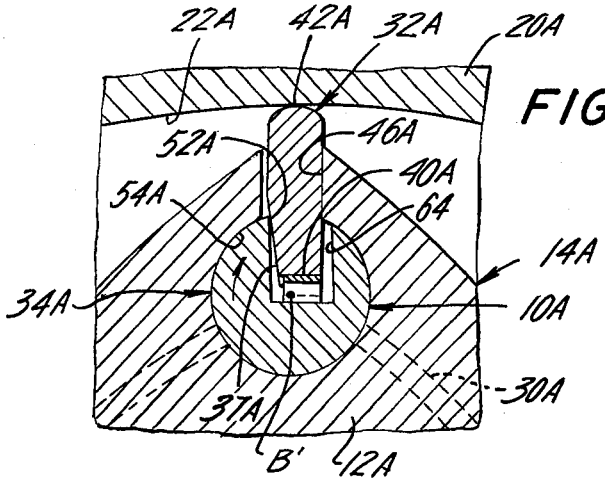
FIG. 4
FIG. 5
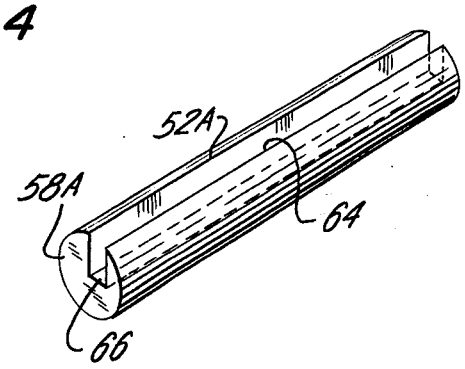
FIG. 6
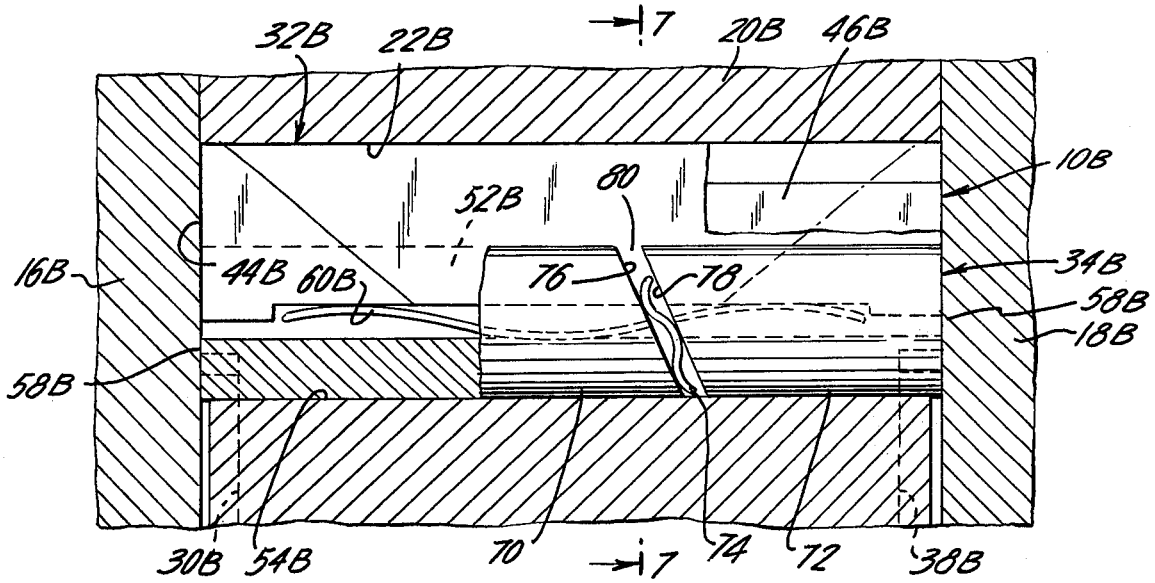
FIG. 7
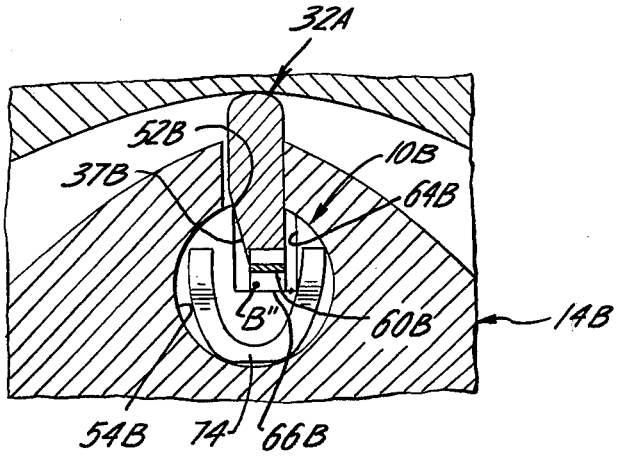

APEX SEAL ASSEMBLY

This invention relates to seals for rotary piston mechanisms of the type disclosed in the U.S. Pat. No. 2,988,065, to Wankel et al, dated June 13, 1961 and more particularly to an improved apex seal assembly.

BACKGROUND OF THE INVENTION

In rotary piston mechanisms of the Wankel-type having a housing defining a multi-lobe cavity and a multi-cornered rotor eccentrically supported for planetary rotation in the housing cavity, considerable effort has been expended to design a seal grid of optimum sealing effectiveness and thereby completely isolate from each other the working chambers defined between the rotor and housing. One of the sealing problem areas of the seal grid is between the seal blade or strip and the slot or groove in the rotor apex and the aligned groove in a seal pin or intermediate seal disposed to extend axially in the rotor apex. The sealing in this area is particularly difficult since, in apex seal assemblies, the gas load on the seals changes as rotor rotates and the pressure within the working chambers changes as the working chambers expand and contract in volumetric size. With these changes in gas pressure differential across the apex seal blade of conventional apex seal assemblies, the seal blade is forced in contact with one side of the aligned grooves in the rotor apex and seal pin and then the other. Thus, as the blade moves from one groove wall to the other, there is, for this brief moment, no positive sealing taking place, only that of a labyrinth. In addition, in a rotary internal combustion engine of the Wankel-type, at low speed, such as during starting and idle, gas pressures are relatively low and, therefore, differential pressure across the seal blade is ineffective and leakage will occur. To overcome these problems, numerous apex seal assemblies have been disigned such as in exemplified in the following U.S. Pats. Nos.

Froede, 3,120,815 dated Feb. 11, 1964
Paschke, 3,180,560 dated Apr. 27, 1965
Pratt, 3,899,272 dated Aug. 12, 1975

The Froede patent apparatus employs a spring biased wedge which coacts with the seal blade to cam the latter into contact with, at least, one side of the apex seal groove or slot. This sealing apparatus is not entirely satisfactory because it does not provide a positive seal between the seal blade and the groove in each of the seal pins.

The patent to Paschke discloses an apex seal assembly in which the seal pin is so formed as to engage the seal blade along a contact line. In one embodiment, the groove in the seal pin is enlarged radially inwardly and in another embodiment the seal pin is a slotted annular seal receivable in an annulus in the rotor apex. In both of these embodiments, the abutment of the ends of the gas seal strips is essential for optimum sealing effectiveness. In a third embodiment, there are provided two slotted annular seals. In these patented devices there is no assurance of the maintenance of the line contact between the seal pin and seal blade under all operating conditions because of the inherent manufacturing tolerances which will permit relative movement between the seal components.

The device of the Pratt patent discloses elongated cylindrical seal pins which are longitudinally and transversely split to form a four-piece element extending the width of the rotor. This construction permits one of the pin elements to pivot under high pressure gas to contact the seal blade. Here again, since the gas is the tilting force, at low engine speed and therefore low gas pressure, there is no assurance that line sealing contact will be maintained. Furthermore, oil and other deposits may clog the passages to the outer surfaces of the pin elements.

It is, therefore, an object of this invention to provide an improved apex seal assembly wherein optimum sealing effectiveness is maintained through all normal operating conditions of the engine.

It is another object of the present invention to provide an improved apex seal assembly which provides positive sealing force regardless of the engine operating condition.

It is a further object of this invention to provide an improved apex seal assembly having optimum sealing effectiveness yet relatively simple and inexpensive to fabricate and assemble into the rotor.

SUMMARY OF THE INVENTION

Accordingly, the present invention contemplates an improved apex seal assembly for each of the apex portions of a rotary piston of the multi-cornered type which has opposite side wall and contiguous peripheral surfaces intersecting each other at apex portions. The apex seal assembly comprises a groove or slot in the apex portion wich extends axially trough the piston side wall surfaces and radially inwardly from peripheral surfaces of the piston. A bore is provided in the piston radially inwardly relative to the slot and to extend axially through the piston side wall surfaces and intersecting the slot so as to communicate with the latter. A seal blade means of suitable type, such as the single piece or multi-blade type such as shown in U.S. Pats. Nos. to Paschke, 3,180,561 dated Apr. 27, 1965; Jones, 3,400,691 dated Sept. 10, 1968; Yamamoto, 3,270,954 dated Sept. 6, 1966; Yamamoto, 3,556,695 dated Jan. 19, 1971; and Gomada, 3,658,451 dated Apr. 25, 1972, is disposed in the slot for movement relative thereto. The seal blade means has a sealing end surface and is dimensioned to extend at least to the planes of the opposite side wall surfaces of the piston and with the sealing end surface lying outwardly of the slot. An intermediate seal means, as for example, seal pins or buttons functionally similar to the types disclosed in the U.S. Pat. to Larrinage et al., No. 3,674,384 dated July 4, 1972, is disposed in the bore for rotative movement therein about an axis of rotation. The intermediate seal means also includes a sealing edge means and is dimensioned to extend at least to the planes of the piston side wall surfaces. A mechanical biasing means, as for example, a spring or springs of leaf or coil type, is disposed to exert a force on the intermediate seal means at a point offset from its rotational axis to thereby urge the intermediate seal means to rotate about the axis of rotation relative to the seal blade means and thereby maintain the sealing edge means in engagement with the seal blade means regardless of the value and the changes in fluid differential pressure across the seal blade means and the centrifugal forces acting thereon.

In one embodiment of this invention the intermediate seal means is a cylindrical member, the longitudinal axis of which is offset from an imaginary plane extending axially through the seal blade means and midway between the opposite sides of the seal blade means. The cylindrical member has a quadrant-shaped notch extending longitudinally the length of the member to thereby form an arris which serves as the seal edge means to engage the seal blade means.

In another embodiment, the intermediate seal means is a cylindrical member, the longitudinal axis of which lies in an imaginary plane extending the length of the member, and mid-way of the opposite sides of the seal blade means. A three-sided groove is formed in the cylindrical member to extend its length and form an arris which serves as a sealing edge when in abutment against the seal blade means. The groove is offset from a plane extending through the longitudinal axis of the cylindrical member so that the mechanical biasing means disposed in the groove exerts a force at a point removed from the longitudinal axis and hence a torque force which rotatively urges the cylindrical member and the sealing arris in abutment against the seal blade means.

In a third embodiment, the intermediate seal means is a two-piececylindrical member with the two parts arranged end-to-end and biased apart by a second biasing means, such as a horseshoe-shaped wave spring.

BRIEF DESCRIPTION OF THE DRAWINGS

The invention will be more fully understood from the following description thereof when considered in connection with the accompanying drawing wherein several embodiments of the invention are illustrated by way of example and in which:

FIG. 4 is a view in cross-section of an apex seal assembly according to a second embodiment of the present invention;

FIG. 5 is a perspective view of the intermediate seal which forms a component of the apex seal assembly shown in FIG. 4;

FIG. 6 is a fragmentary, cross-sectional view (similar to FIG. 3) through a rotary piston mechanism having an apex seal assembly according to a third embodiment of this invention; and FIG. 7 is a view in cross-section taken substantially along line 7—7 of FIG. 6;

DESCRIPTION OF PREFERRED EMBODIMENTS

Figure 1:
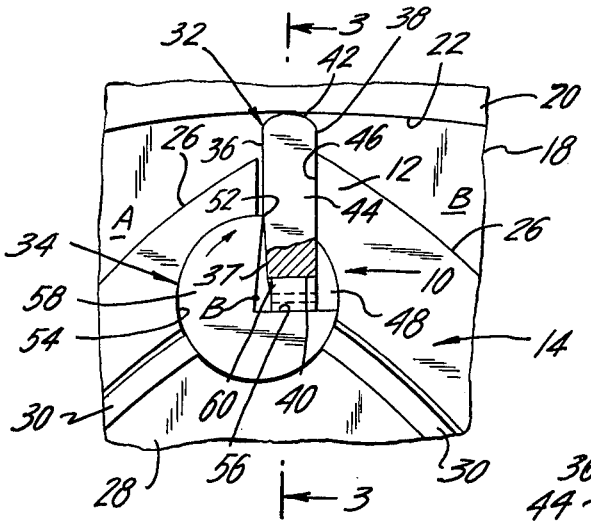
FIG. 1 is a fragmentary end view of the apex portion of a rotary piston mechanism which apex portion has an apex seal assembly according to a first embodiment of this invention.
Figure 2:
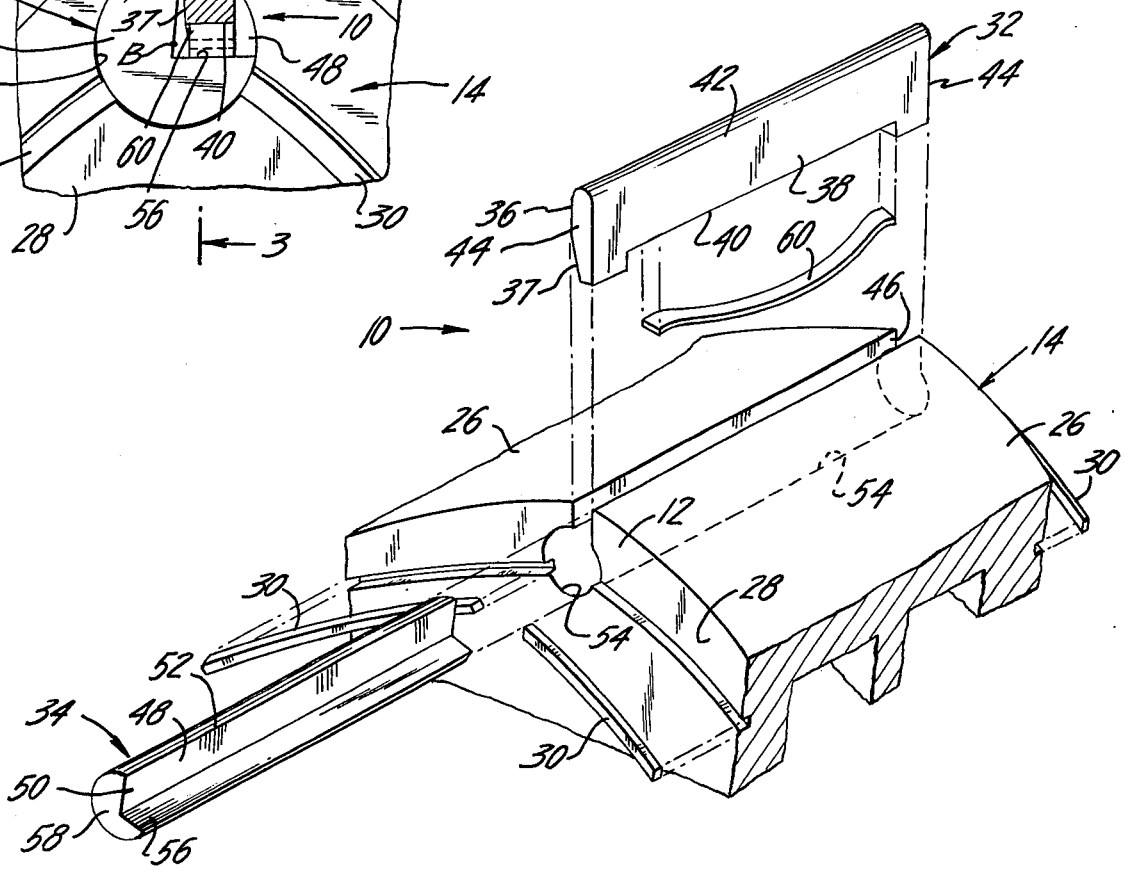
FIG. 2 is an exploded view in perspective of the apex seal assembly shown in FIG. 1.
Figure 3:
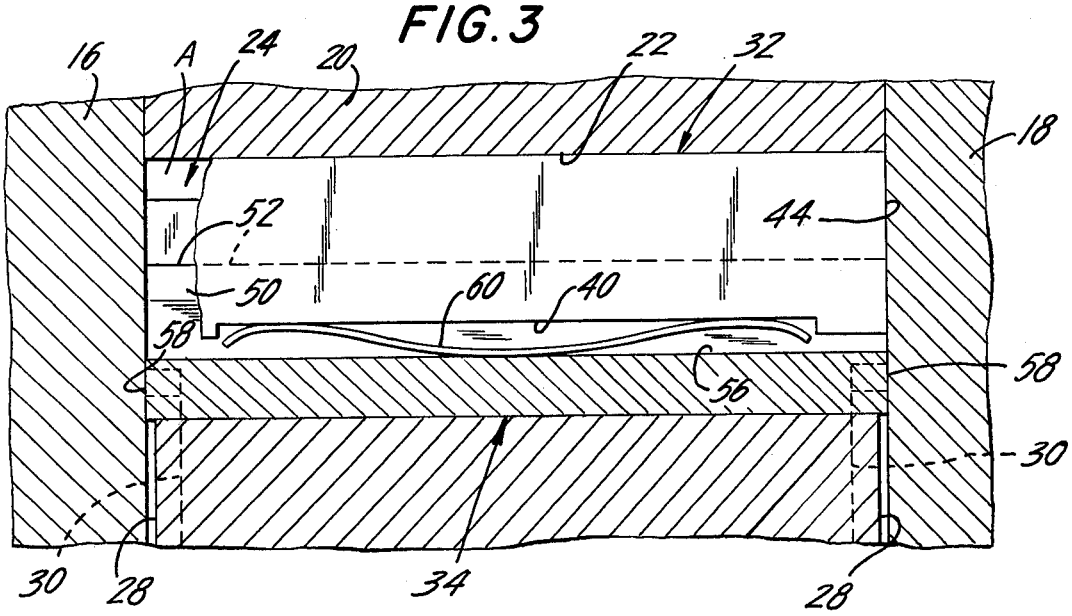
FIG. 3 is a cross-sectional view taken along line 3—3 of FIG. 1.

Referring now to the drawings and more particularly to FIGS. 1 to 3, the reference number 10 generally designates an apex seal assembly according to a first embodiment of this invention, which apex seal assembly is located at each apex portion 12 (only one of which is shown) of a multi-cornered rotor or rotary piston 14 of a rotary piston mechanism which may be of the Wankel-type such as disclosed in the U.S. Pat. No. 2,988,065 to Wankel et al, dated June 13, 1961. While the invention has particular application to a rotary internal combustion engine, the apex seal assembly of this invention is not to be limited to such application since it may be employed in other rotary mechanisms, such as pumps, compressors and expanders. However, for purposes of illustration and because sealing is a very critical factor, the invention will be described in connection with a rotary internal combustion engine of the Wankel-type.

The rotary internal combustion engine, in addition to rotor 14, comprises a housing consisting of two end walls 16 and 18 held in spaced, substantial parallelism by a peripheral wall 20 having an inner peripheral surface 22 of trochoidal configuration (see FIG. 3). The walls 16, 18 and 20 define therebetween a cavity 24 within which rotary piston 14 is eccentrically supported on a mainshaft (not shown) for planetary rotation relative to the housing. The rotary piston 14 and the housing define a plurality of working chambers, two of which are indicated at A and B, which expand and contract in volumetric size as the rotor and the housing rotate relative to each other.

The rotary piston 14 comprises a multi-cornered member having at least two apex portions 12 (only one being shown) which are formed by the intersection of contiguous outer peripheral surfaces or flanks 26 and two opposite side wall faces or surfaces 28 (only portions of surfaces 26 and 28 being illustrated). To isolate the working chambers A and C from each other and surrounding areas, a seal grid, which apex seal assembly 10 and seal strips 30 in rotor side walls 28 forms a part, is mounted in and carried by rotary piston 14.

The apex seal assembly 10 comprises a seal blade 32 of single piece or multi-piece type and a coacting intermediate seal 34 of elongated cylindrical or barrel construction coacting with seal blade 32.

The seal blade 32 is generally rectangular in cross-section and has opposite side wall surfaces 36 and 38, a bottom wall surface 40, a sealing end surface 42 and end wall surfaces 44. The seal blade 32 is disposed in a slot 46 in apex portion 12. The slot 46 extends axially across the full width of the rotary piston, through the side wall surfaces 28, and radially inwardly from the area of intersection of flanks 26. The seal blade 32 is dimensioned in width to be in close fitting relationship with slot 46, but capable of radial movement so that limited lateral movement can occur with respect to the radial walls of slot 46. The seal blade 32 is dimensioned in length to extend to at least the plane of end wall surfaces so that end walls 44 engage the adjacent inner surfaces of walls 16 and 18 (see FIG. 3).

The cylindrical intermediate seal 34 has a generally quadrant-shaped cut-out 48 extending its full length. The radial wall 50 of cut-out 48 forms with the outer peripheral surface of the intermediate seal 34 in arris 52 which serves as a sealing edge as hereinafter more fully explained. The intermediate seal 34 has a diametral dimension so as to be singly receivable in a circular bore 54 in apex portion 12. The bore 54 is located inwardly of slot 46 and extends in intersection with slot 46 the full width of rotary piston 14 and through its side wall surfaces 28. The longitudinal axis B of bore 34 and intermediate seal 34 is positioned in offset relation to an imaginary plane extending radially of rotary piston 14 and mid-way between opposite wall surfaces 36 and 38 of seal blade 32. The relative sizes of seal blade 32 and intermediate seal 34 and cut-out portion 48 are such that, when assembled, the seal blade projects into the cut-out portion 48 with the seal blade bottom wall surface 40 spaced from surface 56 of cut-out portion 48. Also the length of intermediate seal 34 is such that its opposite end surfaces 58 lie at least in the plane of end wall surfaces 28 of rotary piston 14 so that those end surfaces engage the adjacent inner surfaces of housing end walls 16 and 18 (see FIG. 3).

A spring 60, such as the curved leaf spring shown, is disposed between cut-out wall surface 56 and the bottom surface 40 of seal blade 32. The spring 60 exerts a force urging seal blade 32 radially and its sealing end surface 42 into engagement with trochoidal surface 22 of the housing. Simultaneously, with the force on seal blade 32, spring 60 exerts a reaction force on intermediate seal 34 radially inwardly against surface 56 of cut-out 48. As best seen in FIG. 1 this radially inwardly directed force is applied at a point offset from longitudinal axis B of intermediate seal 34 thereby exerting a torque force on the intermediate seal causing it to rotate about axis B until arris 52 abuts side wall surface 36 of seal blade 32 and side wall 38 of seal blade 32 butts against the adjacent wall of slot 46. So as not to interfere with rotative movement of intermediate seal 34, side seal strips 30 abut at their ends the intermediate seal, rather than overlap the intermediate seal as is disclosed in the U.S. Pat. to Anderson, No. 3,102,518 dated Sept. 3, 1963.

In operation of a rotary mechanism containing apex seal assemblies 10, according to this invention, spring 60 constantly exerts a force urging intermediate seal 34 rotatively about its longitudinal axis B to thereby maintain arris 52 in engagement with side wall surface 36 of seal blade 32 regardless of the magnitude of the fluid pressure in working chambers a and B and/or the direction of the differential pressure across seal blade 32. Thus, apex seal assemlby 10 achieves a seal at arris 52 under all operating conditions even when seal blade 32 flops in its associated slot 46. More specifically, when seal blade 32 is forced against the opposite wall of slot 46 from the position shown in FIG. 1, positive sealing is still provided at the arris 52 of intermediate seal 34 and at the abutting surfaces of the intermediate seal and its associated bore 54 to thereby prevent blowby or leakage past the bottom wall surface 40 of seal blade 32. To insure a line contact between arris 52 and side wall surface 36 under all operating conditions, a portion 37 of the side wall surface may be tapered inwardly as shown.

In FIGS. 4 and 5 is shown an apex seal assembly 10A according to a second embodiment of this invention. Apex seal assembly 10A differs from apex seal assembly 10 shown in FIGS. 1 to 3 basically in that the intermediate seal is not eccentrically located relative to the seal blade and its slot and is provided with a three-sided offset slot rather than a quadrant-shaped cut-out portion. In view of the similarities of assemblies 10 and 10A the parts of assembly 10A like those of assembly 10 will be designated by the same number but with the suffix A added thereto.

As shown in FIGS. 4 and 5, apex seal assembly 10A comprises an intermediate seal 34A of elongated cylindrical configuration disposed for rotative movement in a bore 54A in apex portion 12A of rotor 14A, which bore 54A has a longitudinal axis B′ lying substantially in an imaginary plane extending radially midway between the radial walls of slot 46A in apex portion 12A. A seal blade assembly 32A, identical with seal blade assembly 32 of apex seal assembly 10, is disposed in slot 46A. A three-sided slot or groove 64 is formed in intermediate seal 34A to extend longitudinally the length of the intermediate seal. The groove 64 forms a sealing arris 52A, similar to arris 52, of apex seal assembly. The groove 64 is also laterally offset so that an imaginary plane extending parallel to and midway between the side walls of the groove is offset from the longitudinal axis B′ of the intermediate seal 34A. The intermediate seal 34A is disposed in its bore 54A so that its groove 64 is in communication with slot 46A and the inner portion of seal blade assembly 32A can extend into groove 64. A spring 60A is disposed in groove 64 between the latter and bottom 40A of seal blade assembly 32A to bear against the bottom 40A and bottom surface 66 of groove 64. By reason of the offset position of groove 64, spring 60A applies a force to intermediate seal 32A which has a moment arm about axis B′. This torque force constantly urges intermediate seal 34A rotatively and thereby maintains arris 52A in engagement with apex seal assembly 32A. In function, therefore, apex seal assembly 10A of FIGS. 4 and 5 is the same as apex seal assembly 10 shown in FIGS. 1 to 3.

In FIGS. 6 and 7 is shown an apex seal assembly 10B according to a third embodiment of this invention. The apex seal assembly 10B is similar to apex seal assembly 10A and essentially differs from the latter in that intermediate seal is a two-piece element arranged end-to-end in its associated bore rather than a single-piece element of the intermediate seal 34A of apex seal assembly 10A. In view of the similar construction of apex seal assembly 10A and 10B, the parts of apex seal assembly 10B corresponding to parts of apex seal assembly 10A will be designated by the same numbers but with the suffix B added thereto.

As illustrated in FIGS. 6 and 7, apex seal assembly 10B is identical to apex seal assembly 10A except that seal blade 32B is shown as a multi-piece element and intermediate seal 34B is two cylindrical elements 70 and 72 arranged in end-to-end relationship to each other in bore 54B with end surfaces 58B of each element facing outwardly of the bore. A horseshoe-shaped washer 74 is disposed between the adjacent inclined end surfaces 76 and 78 of the respective elements 70 and 72 to thereby bias each of the elements outwardly of bore 54B to maintain end surfaces 58B in contact with the inner surfaces of end walls 16B and 18B of the housing. The elements 70 and 72, as shown, are preferably made of unequal lengths so as to avoid the possibility of the gap 80 between the adjacent surfaces 76 and 78 interfering with the function of spring 60B. The end surface 76 and 78 are inclined at an acute angle relative to the axis B″ to insure that the elements 70 and 72, under the urging of spring 60B rotate as a single unit.

In function, apex seal assembly 10B effects a constant positive seal, similar to the other embodiments, by reason of engagement of arris 52B of elements 70 and 72 with seal blade assembly 32B. However, a small leakage flow path is provided through the gap 80 between elements 70 and 72 which is at least partially compensated for by the improved sealing achieved at the end surfaces 58B and the adjacent inner surfaces of the housing end walls 16B and 18B by reason of the outward bias of elements 70 and 72 by spring 74.

It is now believed readily apparent that the present invention provides an improved apex seal assembly for a rotary piston of a rotary piston mechanism which assembly provides a constant positive seal regardless of the value and changes in pressure differential across the apex seal. It is an apex seal assembly which provides a mechanical force to effect sealing and therefore is independent of fluid pressure and capable of providing an effective seal at low fluid pressure values in the working chambers of the mechanism.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. An improved apex seal assembly for each of the apex portions of a rotary piston having opposite wall surfaces and contiguous peripheral surfaces intersecting each other at the apex portions, the apex seal assembly comprising:

a. a slot in the apex portion extending axially through the piston side wall surfaces and radially inwardly from the peripheral surfaces of the piston;

b. a cylindrical-shaped bore in the apex portion disposed radially inwardly relative to the slot and extending axially through the piston side wall surfaces to intersect and communicate with said slot;

c. a seal blade means having a sealing end surface and a bottom surface receivable in said slot and dimensioned to extend at least to the planes of the opposite side wall surfaces of the piston and with the bottom surface lying in the slot and the sealing end surface lying outwardly of the slot;

d. an elongated cylindrical-shaped intermediate seal means receivable in said bore for rotative movement about its longitudinal axis relative to the bore and seal blade means;

e. said intermediate seal means having a cut-out portion in communication with said slot and forming at least one sealing arris; and f. a spring disposed in the cut-out portion and between the bottom surface of said seal blade means and a wall of the cut-out portion to exert a force on said seal blade means and on the intermediate seal means at a point offset from the latter's rotational axis to thereby urge the intermediate seal means to rotate about said axis relative to the seal blade means and maintain the sealing arris in engagement with the seal blade means.

2. The apparatus of claim 1 wherein said cut-out portion is a generally quadrant-shaped notch, the surfaces of which intersect each other inwardly of the peripheral surface of the intermediate seal means.

3. The apparatus of claim 1 wherein the intermediate seal means comprises two elongated cylindrical members disposed end-to-end in the bore with a biasing means disposed therebetween to urge the two cylidrical members in a direction away from each other and outwardly of the bore.

4. The apparatus of claim 1 wherein said cut-out portion is a three-walled groove extending radially inwardly and the length of the elongated cylindrical-shaped intermediate seal means.

5. The apparatus of claim 4 wherein the three-walled groove is located so that an imaginary plane extending the length of the slot and mid-way between the opposite walls of the slot is offset from the longitudinal axis of the elongated cylindrical-shaped intermediate seal means.

6. An improved apex seal assembly for each of the apex portions of a rotary piston having opposite side wall surfaces and contiguous peripheral surfaces intersecting each other at the apex portions, the apex seal assembly comprising:

a. a slot in the apex portion extending axially through the piston side wall surfaces and radially inwardly from the peripheral surfaces of the piston;

b. an elongated cylindrical bore in the apex portion extending axially through the piston side wall surfaces to intersect and communicate with said slot;

c. a seal blade means having a sealing edge surface, an opposite bottom surface and opposite side wall surfaces;

d. said seal blade means being disposed in said slot for slidable movement relative thereto and dimensioned to extend at least to the planes of the side wall surfaces of the piston and with the sealing end surface projecting outwardly of the slot;

e. an elongated cylindrical seal pin means dimensioned to be snugly receivable in said bore and to extend to at least the plane of the side wall surfaces of the piston;

f. said seal pin means having a cut-out portion extending axially of the seal pin means to receive therein a portion of the seal blade means including its bottom surface;

g. said cut-out portion being such as to form at least one sealing edge; and h. mechanical biasing means disposed in said cut-out and engaging the bottom surface of said seal blade means and the seal pin means at a point offset from its longitudinal axis to exert a rotative force on the seal pin means to thereby maintain the sealing edge of said seal pin means in engagement with one of the side walls of the seal blade means regardless of the value and the changes in fluid differential pressure across said seal blade means and the centrifugal forces acting thereon.

7. The apparatus of claim 6 wherein the cut-out portion is a generally quadrant-shaped notch, the surfaces of which intersect each other inwardly of the peripheral surface of the seal pin means.

8. The apparatus of claim 6 wherein the longitudial axis of the seal pin means is in an imaginary plane offset from an imaginary plane extending radially through the middle of the seal blade means.

9. The apparatus of claim 6 wherein a portion of the wall surface of the seal blade means engaged by the sealing edge of the seal pin is canted relative to the plane of the other wall surface of the seal blade means.

10. The apparatus of claim 6 wherein said seal pin means comprises two elongated elements disposed in the bore in end-to-end relationship and having a biasing means disposed to resiliently urge the elements away from each other and in a direction outwardly of the bore.

11. The apparatus of claim 6 wherein said longitudinal axis of the seal pin means lies in an imaginary radial plane extending through the middle of the seal blade means and the cut-out portion is a three-walled groove extending the length of the seal pin and having opposite wall surfaces and a bottom surface.

12. The apparatus of claim 11 wherein the groove is so located that an imaginary plane mid-way between the opposite side wall surfaces of the groove does not pass through the longitudinal axis of the seal pin means.

* * * * *